United States Patent [19]

Sawatani et al.

[11] 4,373,971

[45] Feb. 15, 1983

[54] PROCESS FOR THE PRODUCTION OF FERRITIC STAINLESS STEEL SHEETS OR STRIPS AND PRODUCTS PRODUCED BY SAID PROCESS

[75] Inventors: Tadashi Sawatani; Mitsuo Ishii, both of Hikari; Hirofumi Yoshimura, Fukuoka, all of Japan

[73] Assignee: Nippon Steel Corporation, Tokyo, Japan

[21] Appl. No.: 222,762

[22] Filed: Jan. 6, 1981

[30] Foreign Application Priority Data

Jan. 11, 1980 [JP] Japan ..... 55-1883

[51] Int. Cl.[3] ..... C21D 8/02; C21D 9/46

[52] U.S. Cl. ..... 148/12 EA; 148/12.3; 148/135

[58] Field of Search ..... 148/12 E, 12 EA, 12.4, 148/12.3, 37, 135, 142; 75/124 F, 124 C, 126 J

[56] References Cited

U.S. PATENT DOCUMENTS

| | | | |
|---|---|---|---|
| 2,808,353 | 10/1957 | Leffingwell et al. | 148/12 |
| 3,607,237 | 9/1971 | Kalita | 75/124 FA |
| 3,655,459 | 4/1972 | Brickner et al. | 148/12 EA |
| 4,078,919 | 3/1978 | Kado et al. | 75/124 CA |

FOREIGN PATENT DOCUMENTS

| | | | |
|---|---|---|---|
| 47-1878 | 1/1972 | Japan . | |
| 48-84019 | 11/1973 | Japan . | |
| 49-16698 | 4/1974 | Japan | 148/12 EA |
| 51-62112 | 5/1976 | Japan | 75/126 J |
| 51-30008 | 8/1976 | Japan . | |
| 51-44888 | 12/1976 | Japan . | |
| 1162562 | 8/1969 | United Kingdom . | |

OTHER PUBLICATIONS

Peckner et al, Handbook of Stainless Steels, "Structure and Constitution of Wrought Ferretic Steels", McGraw-Hill Book Co., 1977, pp. 5-1 to 5-40 & 14-2.

*Primary Examiner*—Peter K. Skiff
*Attorney, Agent, or Firm*—Kenyon & Kenyon

[57] ABSTRACT

In a process for the production of cold rolled ferritic stainless steel sheets or strips, a hot rolled strips has been annealed by a long time batchwise annealing and cold rolling and recrystallization annealing have been repeated usually twice. In the present invention, a hot rolled steel strip of an Al-containing ferritic stainless steel is heated by continuous annealing to a temperature of from 850° to 1100° C., AlN (aluminum nitride) is precipitated in the dispersed state and then cooling the strip to a temperature of 700° to 900° C., performing subsequent cooling to a level not higher than 200° C. at such a cooling rate that a chromium depletion layer, which causes a gold dust defect, is not formed around the chromium carbonitride. Single cold rolling and recrystallization annealing are carried out in combination until the thickness is reduced to the gauge thickness.

9 Claims, 5 Drawing Figures

( X 15000 )

PROCESS FOR THE PRODUCTION OF FERRITIC STAINLESS STEEL SHEETS OR STRIPS AND PRODUCTS PRODUCED BY SAID PROCESS

BACKGROUND OF THE INVENTION (1) Field of the Invention

The present invention relates to a process for the production of ferritic stainless steel sheets or strips in which the production steps are simplified and products comparable or superior to products of conventional processes can be obtained.

(2) Description of the Prior Art

Cold-rolled products of ferritic stainless steels have heretofore been produced by box-annealing a hot rolled steel strip coil at 800° to 850° C. batchwise and repeating cold rolling and recrystallization annealing two times in many cases. Since a hot rolled steel strip has a heterogeneous micro-structure, if this strip is directly subjected to cold rolling, a desired formability cannot be obtained and therefore, batchwise diffusion annealing should be conducted for a long time prior to the cold rolling. However, in order to heat a long coil strip uniformly even to the interior portion of the coil and effect diffusion annealing, the coil should be kept in a furnace for more than 40 hours and thus the entire production time becomes very long, with the result that the manufacturing cost is inevitably increased.

As means for eliminating such disadvantage of long-time batchwise diffusion annealing of ferritic stainless steels, proposals have been made on the so-called continuous annealing process in which a coil is uncoiled and is continuously conveyed through a furnace, or sheets are conveyed one at a time through the furnace. In the following strips and sheets are therefor the equivalent of one another because in both cases a single layer of sheet-gauge steel is conveyed continuously through the furnace.

When a hot rolled strip of a ferritic stainless steel is subjected to continuous annealing instead of conventional batchwise annealing, the strip should necessarily be heated at a higher temperature than that adopted in the conventional process, and if this strip is heated at a high temperature, the ferritic steel is transformed into an austenite-ferrite mixed phase structure.

Japanese Patent Publication No. 30008/76 discloses a continuously annealing process in which a hot rolled strip of ferritic stainless steel is heated at a temperature of from 1330° to 1350° C. exceeding the austenite-ferrite mixed phase region for a short time of less than 3 minutes and the heated steel strip is air-cooled or rapidly cooled at an elevated cooling speed. Furthermore, Japanese Patent Publication No. 1878/72 discloses a continuous annealing process in which a hot rolled strip of ferritic stainless steel is heated at a temperature of from 930° to 990° C. where the austenite and ferrite phases co-exist, for a time shorter than 10 minutes and the heated strip is air-cooled or rapidly cooled at an elevated cooling rate. However, in these conventional continuously annealing processes the austenite phase formed at the annealing step is transformed to a martensite phase during the cooling step, and troubles are caused, for example, at the subsequent cold rolling step. They are rupture of a strip at the cold rolling step and intergranular corrosion at the annealing and pickling steps.

In the process disclosed in U.S. Pat. No 2,808,353, occurrence of such troubles is prevented because a hot rolled strip of ferritic stainless steel is heated at a high temperature of 927° to 1149° C. for from 1 to 10 minutes and is then annealed at 760° to 899° C. batchwise.

As the process using an additive element, a process comprising continuously annealing a hot rolled strip of a Ti-added ferritic stainless steel at 950°±20° C. for a time shorter than 10 minutes is disclosed in Japanese Patent Application Laid-open Specification No. 84019/73.

As described hereinafter, the present invention is directed to the production of Al-containing ferritic stainless steel sheets or strips. The use of Al as an additive element is discosed in, for example, British Pat. No. 1,162,562 and Japanese Patent Publication No. 44888/76.

SUMMARY OF THE INVENTION

It is an object of the present invention to provide a process for the production of ferritic stainless steel sheets or strips in which annealing of a hot rolled strip of a ferritic stainless steel is performed according to a short-time continuous annealing process instead of the conventional batchwise annealing process.

It is another object of the present invention to provide a cold rolled product of ferritic stainless steel which is comparable or superior to the conventional products in both the anti-ridging property and deep drawing property and is free of defects such as the gold dust defect. By the term "gold dust defect" is meant such a defect that when a protecting film of a vinyl resin or the like applied to a product sheet is peeled, the surface of the product sheet is partially removed and the surface glitters.

Another object of the present invention is to provide a process for the production of ferritic stainless steel sheet products which are comparable or superior to the conventional products and are free of defects such as the gold dust defect, notwithstanding the simplification of twice repeated cold rolling and annealing steps for obtaining desired gauge thickness in the conventional process (hereinafter referred to as "2CR") to a single cold rolling and annealing (hereinafter referred to as "1CR").

The process of the present invention is characterized in that a hot rolled strip of an Al-containing ferritic stainless steel is continuously annealed with such a heat pattern that AlN is precipitated in dispersed state and further a chromium depletion layer which causes the gold dust defect is not formed.

DETAILED DESCRIPTION OF THE PREFERRED EMBODIMENTS

Figure 4:
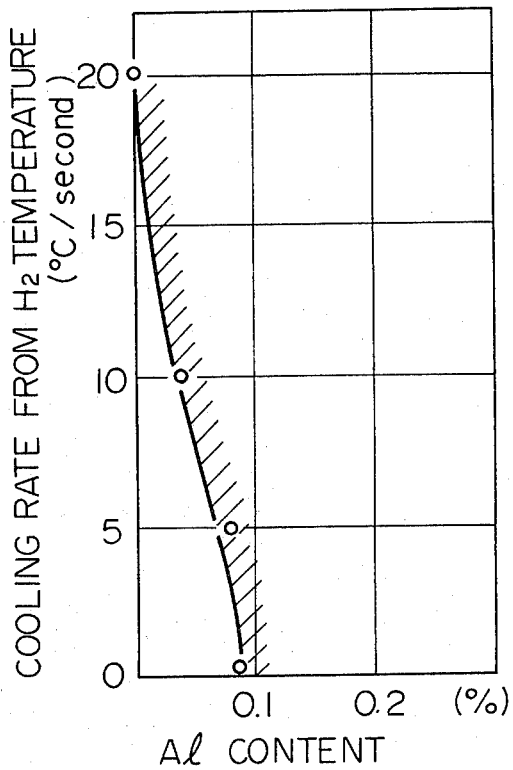
FIG. 4 is a curve showing a controlled rate of cooling from the $H_2$ temperature according to the Al content.

In the process of the present invention, a hot rolled strip of an Al-containing ferritic stainless steel prepared according to a customary method is continuously annealed so as to be heated to a temperature of from 850° to 1100° C. (hereinafter referred to as "$H_1$ temperature"), whereby a part or substantially all of AlN (aluminum nitride) composed of Al and N which is contained in the stainless steel formed by a customary melting process is dissolve d into a solid solution. Then, the heated strip is cooled down to a temperature of from 700° to 900° C. (hereinafter referred to as "$H_2$ temperature") and AlN is precipitated in a dispersed state during this cooling step. In order to prevent the so-called gold dust defect caused by local deterioration of the corrosion resistance which is considered to be due to a chromium depletion layer generated around relatively large chromium carbonitride precipitates present in the grain boundaries, a controlled cooling to a temperature not higher than 200° C. is then carried out in relation to the Al content. More specifically, when the Al content is high, the precipitated amount of AlN is large and the precipitated amount of chromium carbonitride is accordingly suppressed. Accordingly, in this case, a cooling rate may be low. When the Al content is low, the effect of AlN suppressing the precipitation of chromium carbonitride is low. Accordingly, in this case, a higher cooling rate is preferred. Therefore, the cooling rate is controlled within the range shown in FIG. 4, as described in detail hereinafter.

The hot rolled and annealed steel strip in the state where AlN is precipitated in a dispersed state is cold rolled and subjected to a recrystallization annealing, whereby a product comparable or superior to the conventional products in the deep drawing property, anti-ridging property and corrosion resistance is obtained.

The ferritic stainless steel sheet or strip provided by the present invention is characterized by the combination of:

the composition which comprises not more than 0.12% of carbon, from 15 to 20% of chromium, up to 0.025% of nitrogen and aluminum in an amount of at least twice the nitrogen content being 0.4% at the highest, the balance being essentially iron;

the final processing state of cold rolling followed by recrystallization annealing, and;

a phase micro-structure of aluminum nitride precipitates in a dispersed state and there is no such a chromium depletion layer around the carbonitride, as causing a gold dust defect. The constituent phase of the materix is usually ferrite.

When the $H_1$ temperature is lower than 850° C., the quantity of solubility products of AlN is reduced, and when the $H_1$ temperature is higher than 1100° C., coarsening of the crystal grains occurs. In each case, the deep drawing property and other properties of the final product are impaired.

When the $H_2$ temperature is higher than 900° C., the precipitation of AlN becomes insufficient to prevent deterioration of deep drawability of the final product. When the $H_2$ temperature is lower than 700° C., relatively large particles of chromium carbonitride are liable to precipitate in the grain boundaries. When such a precipitation of carbonitride takes place, a chromium depletion layer is formed around each of the precipitates and thus local deterioration of the corrosion resistance is caused, with the result that so-called gold dusting is very liable to be generated. The corrosion resistance is influenced also by the Al content. Ordinarily, a higher Al content gives a higher corrosion resistance, but in order to maintain a better corrosion resistance, it is indispensable that the $H_2$ temperature should be at least 700° C. When the $H_1$ temperature is lower than 900° C., the $H_2$ temperature is of course adjusted to a level lower than the $H_1$ temperature.

For precipitating AlN in a dispersed state during the course of cooling from the $H_1$ temperature to the $H_2$ temperature, there may be a method in which cooling is continuously carried out and a method in which cooling is effected to the $H_2$ temperature is followed by holding at the $H_2$ temperature.

When the strip is continuously cooled from the $H_1$ temperature to the $H_2$ temperature (700° to 900° C.) at a constant or varied cooling rate, the average cooling rate should be lower than 15° C./sec. Influences of the cooling rate on the characteristics such as the deep drawing property have a close relation to the Al content. When the cooling rate is higher in a range less than 15° C./sec, a large effect is obtained at a higher Al content, and the effect is relatively reduced at a lower Al content. When the cooling rate is 15° C./sec or more, precipitation of AlN is insufficient and the deep drawing property of the product is reduced. When cooling from the $H_1$ temperature to the $H_2$ temperature is conducted at a rate higher than 15° C./sec, the strip is held at the $H_2$ temperature to precipitate AlN in dispersed state.

The foregoing is equally applicable to sheets conveyed one at a time through the continuous furnace.

The present invention will now be described in detail with reference to the following Examples.

EXAMPLE 1

Hot rolled steel sheets prepared according to a customary melting method and under customary rolling conditions from 17Cr ferritic stainless steels differing in the Al content as shown in Table 1, were continuously annealed so as to be heated to 1000° C. as the $H_1$ temperature and then control-cooled. The rate of cooling from $H_1$ to $H_2$ was occasionally higher in the higher temperature range and lower in the lower temperature range, or the cooling rate was occasionally lower in the higher temperature range and higher in the lower temperature range. However, the average cooling rate calculated from the difference between $H_1$ and $H_2$ and the time required for this cooling was adopted as the cooling rate.

The thus treated steel sheets were descaled and cold rolled until the thickness was reduced to a thickness of 0.7 mm, and then, the steel sheets were subjected to a recrystallization annealing at 830° C. The cold rolling procedures were both 1CR, wherein the 0.7 mm thick sheets were obtained by single cold rolling without intermediate recrystallization annealing, and; 2CR, wherein, after an intermediate recrystallization annealing of a 2.0 mm thick cold rolled strip the sheet thickness was finally reduced to 0.7 mm.

TABLE 1

| Samples | Chemical Compositions (% by weight) of Samples ELEMENTS | | | | | | | | |
|---|---|---|---|---|---|---|---|---|---|
| | C | Si | Mn | P | S | Ni | Cr | Al | N |
| A | 0.05 | 0.30 | 0.21 | 0.021 | 0.008 | 0.21 | 16.60 | 0.030 | 0.0061 |
| B | 0.06 | 0.32 | 0.25 | 0.018 | 0.007 | 0.18 | 16.81 | 0.076 | 0.0101 |
| C | 0.05 | 0.35 | 0.21 | 0.019 | 0.008 | 0.19 | 16.71 | 0.151 | 0.0121 |
| D | 0.06 | 0.33 | 0.25 | 0.020 | 0.008 | 0.21 | 16.61 | 0.301 | 0.0135 |
| E | 0.05 | 0.29 | 0.21 | 0.023 | 0.006 | 0.18 | 16.55 | 0.405 | 0.0145 |

For comparison, similar hot rolled sheets annealed under conventional box annealing conditions (heating at 815° C. and cooling in the furnace) were subjected to cold rolling and recrystallization annealing to reduce the thickness to 0.7 mm.

In each of the sheets having a thickness of 0.7 mm, the r values indicating the deep drawing property were measured, and the average value $\bar{r}=(r_0+2r_{45}+r_{90})/4$ was calculated. Furthermore, in each sheet, the ridging height was measured. Incidentally, $r_0$, $r_{45}$ and $r_{90}$ mean r values in directions inclined by 0°, 45° and 90°, respectively, to the rolling direction. The cooling conditions, cold rolling conditions and properties of the product sheets are shown in Table 2.

TABLE 2

Conditions of Cooling of Hot Rolled Sheets fram $H_1$ Temperature of 1000° C., Cold Rolling Conditions and Properties of Products

| Kind of Steel | Run Nos. | Samples | Al content (%) | $H_2$ temperature (°C.) | Average Rate (°C./sec) of Cooling from $H_1$ to $H_2$ | Rate (°C./sec) of Cooling from $H_2$ temperature to 200° C. | Cold Rolling and Annealing | $\bar{r}$ Value* | Ridging Height* (μ) |
|---|---|---|---|---|---|---|---|---|---|
| low Al steels | ① | A | 0.030 | 950 | 0.5 | 30 | 1 CR | 1.05 | 14 |
| | ② | " | " | 800 | " | " | " | 1.25 | 16 |
| | ③ | B | 0.076 | 800 | 8.0 | " | " | 1.20 | 15 |
| | ④ | A | 0.030 | 600 | 2.0 | " | " | 1.15 | 14 |
| high Al steels | ⑤ | C | 0.151 | 950 | 0.5 | " | " | 1.15 | 14 |
| | ⑥ | " | " | 900 | 0.8 | " | " | 1.25 | 16 |
| | ⑦ | " | " | 800 | 1.5 | " | 1,2 CR | 1.25, 1.30 | 17, 17 |
| | ⑧ | D | 0.301 | 700 | 10.0 | " | 1 CR | 1.25 | 18 |
| | ⑨ | " | " | " | 15.0 | " | " | 1.10 | 18 |
| | ⑩ | E | 0.405 | " | 13.0 | " | " | 1.10 | 18 |
| | ⑪ | C | 0.151 | 500 | 1.5 | " | " | 1.25 | 17 |

Note:

*$\bar{r}$ value = 1.2 and ridging height = 18μ in conventional product

Figure 1:
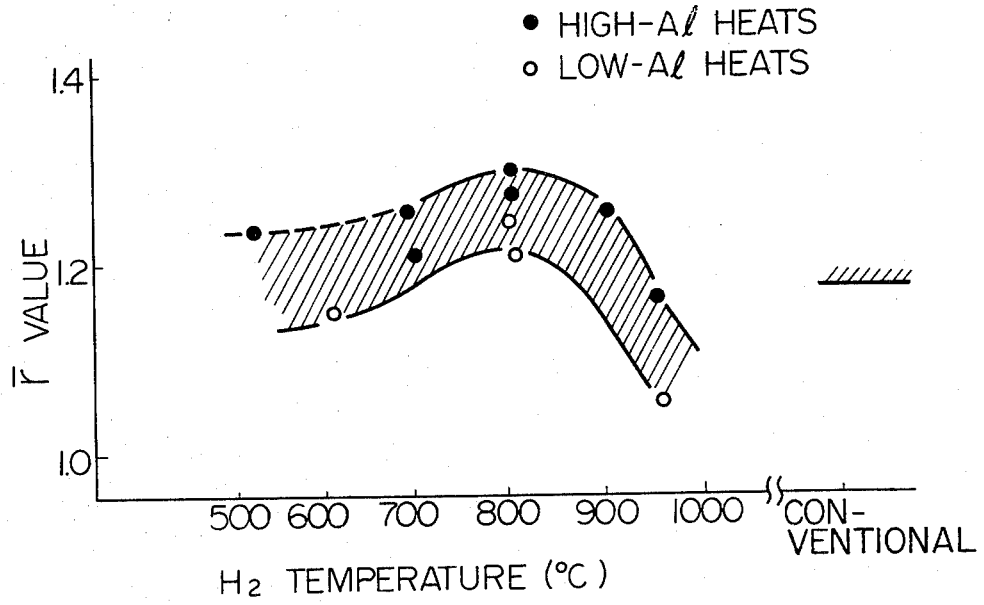
FIG. 1 is a diagram illustrating the relation between the $H_2$ temperature and the $\bar{r}$ value.
Figure 2:
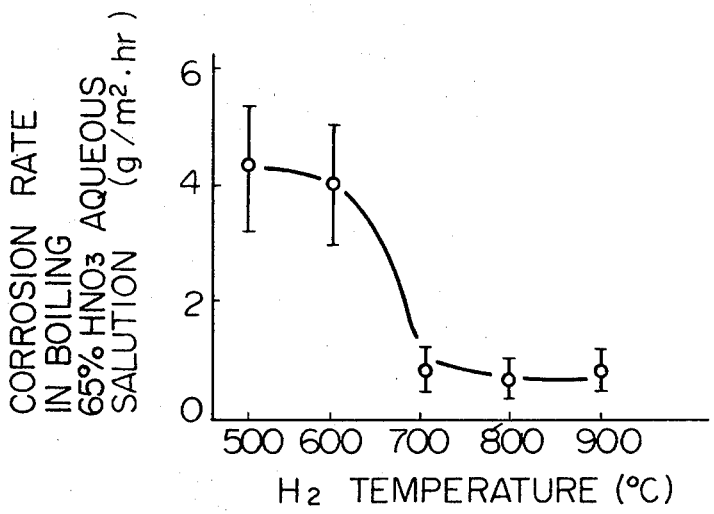
FIG. 2 is a diagram illustrating the relation between the $H_2$ temperature and the corrosion rate.

The relation between the $\bar{r}$ value and the $H_2$ temperature (average rate of cooling from $H_1$ to $H_2$ being not higher than 15° C./sec) was determined to obtain results shown in FIG. 1. It is seen that when cooling down to the $H_2$ temperature, which is higher than 900° C., is effected at a rate not higher than 15° C./sec followed by rapid cooling, the $\bar{r}$ value is drastically reduced with the temperature increase higher than 900° C. There is a certain relation between the $\bar{r}$ value and the Al content, and in case of the higher Al steels, a considerably high $\bar{r}$ value is obtained even if the $H_2$ temperature is lower than 700° C. From the results of the corrosion test described hereinafter, however, it is seen that the $H_2$ temperature should not be lower than 700° C. More specifically, in order to investigate intergranular corrosion owing to precipitation of chromium carbonitrides in the grain boundaries, the relation between the corrosion rate in a boiling 65% aqueous solution of nitric acid and the $H_2$ temperature was determined with respect to Samples C in experiments including the conditions not specified in Table 2. The results are shown in FIG. 2. It is seen that when the $H_2$ temperature is lower than 700° C., the corrosion weight loss is drastically increased and the corrosion resistance is impaired. For these reasons, the $H_2$ temperature is adjusted to from 700° to 900° C. in the present invention.

The dependency of the anti-ridging property on the $H_2$ temperature is small, and the anti-ridging property of products obtained at the $H_2$ temperature of from 700° to 900° C. is comparable to that of the conventional products.

Figure 3:
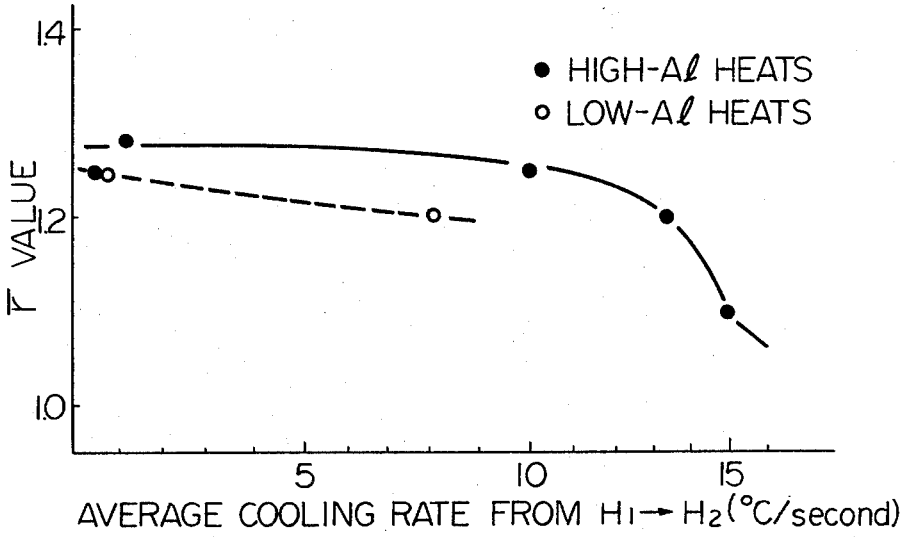
FIG. 3 is a diagram illustrating influences of the average rate of cooling from $H_1$ to $H_2$ on the $\bar{r}$ value.

The influence of the average rate of cooling from $H_1$ to $H_2$ on the $\bar{r}$ value is shown in FIG. 3. It is seen that the average rate of cooling from $H_1$ to $H_2$ should be less than 15° C./sec. The $\bar{r}$ value is influenced also by the Al content even if the average cooling rate is within the above range. More specifically, in case of a higher Al content, a high $\bar{r}$ value is obtained also at a high cooling rate, but in case of a low Al content, the $\bar{r}$ value tends to decrease if the cooling rate is high. Accordingly, a low cooling rate, especially lower than 10° C./sec, is ordinarily preferred.

The rate of cooling from the $H_2$ temperature to a level not higher than 200° C. is controlled according to the Al content. More specifically, the samples differing in the Al content were cooled at various cooling rates from the temperature $H_2$ to a level not higher than 200° C., and intergranular corrosion by a boiling 65% aqueous solution of nitric acid was example to determine a cooling rate providing a corrosion rate of 1 g/m²·hr or less, which is practically negligible. It was found that the cooling rate should be in the range above the curve shown in FIG. 4. Namely, in case of a low Al content, the cooling rate should be at least about 10° C./sec, but in case of a high Al content, a lower cooling rate may be adopted.

Figure 5:
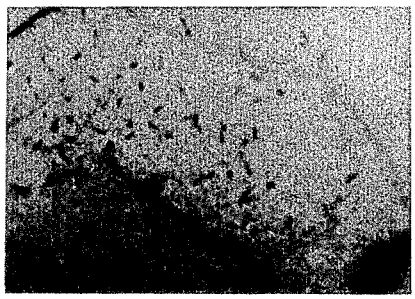
FIG. 5 is an electron micrograph showing the metallographic structure of a steel sheet prepared according to the process of the present invention.

In the foregoing Example, Al-containing ferritic stainless steel sheets were treated according to the process of the present invention, and products having a metallographic structure, for example, as shown in an electron micrograph (15,000 magnifications) of FIG. 5, was obtained. As is seen from FIG. 5, in the product treated according to the process of the present invention, aluminum nitrides (AlN) having rectangular shape are precipitated in a dispersed state. It is believed that recrystallized grains having a crystal orientation for improving the r value grow, at the recrystallization annealing step, because of dispersed AlN precipitates in the cold rolled steel. It is preferred that the lower limit of the amount of Al added be 2 times the N content, and as is seen from FIG. 1, the intended effect can be attained if the upper limit of the amount of Al added is about 0.4%.

EXAMPLE 2

An embodiment in which cooling from the $H_1$ temperature to the $H_2$ temperature is adjusted to a rate not lower than 15° C. followed by holding at the $H_2$ temperature, will now be described in detail.

A hot rolled sheet of an Al-containing ferritic stainless steel (Sample F shown in Table 3), having a thickness of 3.8 mm, was conveyed through a continuous annealing furnace, where the steel sheet was heated at 1000° C. for 1 minute, then held at 800° C. for 2 minutes and rapidly cooled from 800° C. to room temperature at a cooling rate of 10° C./sec. After this heat treatment, the steel sheet was descaled and was then cold rolled by the 1 CR method without intermediate annealing until the thickness was reduced to 0.7 mm, and recrystallization annealing was carried out at 830° C. for 2 minutes. For comparison, hot rolled SUS (AISI) 430 sheets having an ordinary composition G shown in Table 3, which had a thickness of 3.8 mm, were annealed at 815° C. for 2 hours under customary box annealing conditions, and then cold-rolled to 0.7 mm by the 1CR method or 2CR method (intermediate annealing was carried out at 830° C. for 2 minutes when the thickness was 2.0 mm). Then, the sheets were subjected to recrystallization annealing at 830° C. for 2 minutes.

TABLE 3

| | Chemical Compositions (%) of Samples | | | | | | | |
|---|---|---|---|---|---|---|---|---|
| Sample | C | Si | Mn | P | S | Cr | Al | N |
| F | 0.05 | 0.3 | 0.13 | 0.025 | 0.007 | 16.59 | 0.078 | 0.012 |
| G | 0.06 | 0.4 | 0.34 | 0.029 | 0.005 | 16.36 | — | 0.016 |

Properties of the thus obtained product sheets having a thickness of 0.7 mm are shown in Table 4.

TABLE 4

Tensile Characteristics, $\bar{r}$ Value and Anti-Ridging Property

| Steel | Step | Yield Point (kg/mm$^2$) | Tensile Strength (kg/mm$^2$) | Elongation (%) | $\bar{r}$ Value | Ridging |
|---|---|---|---|---|---|---|
| Al-Added steel | 1CR | 33.4 | 50.2 | 31.3 | 1.18 | 12 |
| SUS430 | 1CR | 37.1 | 51.7 | 28.2 | 0.93 | 25 |
| SUS430 | 2CR | 35.3 | 50.5 | 29.5 | 1.16 | 15 |

The 1CR steel sheet of the Al-containing ferritic stainless steel heat-treated according to the present invention is excellent over the comparative 1CR steel sheet of SUS 430 in its tensile characteristics, the $\bar{r}$ value indicating the deep drawing property and its anti-ridging property. Furthermore, the 1CR sheet of the present invention is comparable or superior to the 2CR sheet of SUS 430 in its tensile characteristics, $\bar{r}$ value and anti-ridging property.

As will readily be understood from the foregoing description according to the present invention, there can be provided a ferritic stainless steel sheets or strips which are comparable or superior to the conventional products in the deep drawing property, anti-ridging property and corrosion resistance. Furthermore, annealing of a hot rolled steel sheet can be accomplished by a short-time continuous annealing step instead of the conventional box annealing step which must be conducted for a long time. In addition by combining the cold rolling step and the annealing step, there can be attained an effect of enabling continuous production of ferritic stainless steels for the deep drawing application.

Moreover, according to the present invention, ferritic stainless steel sheets or strips comparable or superior to conventional 2CR products in its tensile characteristics, deep drawing property and anti-ridging property can be obtained by the 1CR step.

We claim:

1. A process for the production of a ferritic stainless steel sheet or strip, characterized by carrying out a continuous annealing process comprising heating a hot rolled steel sheet or strip of an Al-containing ferritic stainless steel at a temperature of from 850° to 1100° C., hereinafter referred to as $H_1$ temperature, by continuous annealing, then precipitating aluminum nitride, in a dispersed state, by cooling the strip down to a temperature of from 700° to 900° C., hereinafter referred to as $H_2$ temperature, performing subsequent cooling to a level not higher than 200° C. at such a cooling rate that a chromium depletion layer, which may cause a gold dust defect, is not formed, and carrying out cold rolling and recrystallization annealing in combination until the sheet or strip thickness is reduced to desired gauge thickness.

2. A process for the production of a ferritic stainless steel sheet or strip according to claim 1, wherein the average cooling rate from said $H_1$ temperature to said $H_2$ temperature is lower than 15° C./sec, cooling the strip to a level not higher than 200° C. at a cooling rate controlled in relation to the Al content, thereby preventing the generation of said chromium depletion layer.

3. A process for the production of a ferritic stainless steel sheet or strip according to claim 2, said cooling rate controlled in relation to the Al content falls within the hatched line region of FIG. 4 appended hereto.

4. A process for the production of a ferritic stainless steel sheet or strip according to claim 1 or 2, wherein said cold rolling is carried out until the gauge thickness is obtained without intermediate annealing.

5. A process for the production of a ferritic stainless steel sheet or strip, characterized by carrying out a continuous annealing process comprising heating a hot rolled steel sheet or strip of an Al-containing ferritic stainless steel at a temperature of 850° to 1100° C., hereinafter referred to as $H_1$ temperature, by continuous annealing, then precipitating aluminum nitride in the dispersed state by cooling the strip down to a temperature of from 700° to 900° C., hereinafter referred to as $H_2$ temperature, at a cooling rate not less than 15° C./sec, followed by holding at said $H_2$ temperature, performing subsequent cooling to a level not higher than 200° C. at a cooling rate controlled in relation to the Al content, thereby a generation of a chromium depletion layer is suppressed due to precipitation of aluminum nitride, and carrying out a cold rolling and a recrystallization annealing in combination until the sheet or strip thickness is reduced to desired gauge thickness.

6. A process for the production of a ferritic stainless steel sheet or strip according to claim 5, said cooling rate controlled in relation to the Al content falls within the hatched line region of FIG. 4 appended hereto.

7. A process for the production of a ferritic stainless steel sheet or strip according to claim 5, wherein said cold rolling is carried out until the guage thickness in obtained without intermediate annealing.

8. A cold rolled and recrystallization annealed sheet or strip of ferritic stainless steel produced by the process of according to claim 1, or 5: comprising not more than 0.12% of carbon, from 15 to 20% of chromium, up to 0.025% of nitrogen and aluminum in an amount of at least twice the nitrogen content but 0.4% at the highest, the balance being essentially iron, and; having a microstructure, in which aluminum nitride is precipitated in a dispersed state and further a chromium depletion layer, which causes a gold dust defect, is not formed around carbonitride.

9. A process for producing a cold-rolled ferritic stainless steel sheet or strip product from a hot-rolled sheet or strip containing from 10 to 20% chromium, nitrogen up to 0.025% and aluminum in an amount of at least twice the nitrogen content and not higher than 0.4%, the balance being essentially iron; in which by a short-time continuous annealing process the sheet or strip is heated to a temperature of from 850° to 1100° C. so as to dissolve into a solid solution aluminum nitride, is then cooled at an average cooling rate of not more than 15° C./sec to from 900° to 700° C. so as to precipitate in a dispersed state the aluminum nitride, and is then cooled to a temperature not higher than 200° C. at a rate of at least 5° C./sec and so as to prevent large amounts of chromium carbonitride precipitates forming, and then cold-rolling the sheet or strip and recrystallization annealing the sheet to produce said product.

* * * * *